US005448783A

United States Patent [19]

Ryan

[11] Patent Number: 5,448,783

[45] Date of Patent: Sep. 12, 1995

[54] URINAL DRIP GUARD FOR USE WITH WALL URINALS

[76] Inventor: Patrick H. Ryan, Rte. 4, Box 326, Crawfordsville, Ind. 47933

[21] Appl. No.: 285,139

[22] Filed: Aug. 3, 1994

[51] Int. Cl.[6] ..... E03D 9/00; E03C 1/181

[52] U.S. Cl. ..... 4/300.3; 4/658

[58] Field of Search ..... 4/300.3, 301, 310, 520, 4/523, 559, 609, 657, 658

[56] References Cited

U.S. PATENT DOCUMENTS

| | | | |
|---|---|---|---|
| 1,302,658 | 5/1919 | Henning | 4/658 |
| 2,131,111 | 9/1938 | Marsh | 4/648 |
| 4,649,580 | 3/1987 | Bastien | 4/520 X |

FOREIGN PATENT DOCUMENTS

| | | | |
|---|---|---|---|
| 0594166 | 11/1947 | United Kingdom | 4/658 |

*Primary Examiner*—Robert M. Fetsuga

[57] ABSTRACT

A urinal drip guard for use with wall urinals comprising a strip of flexible material having top edge, a bottom edge, and an intermediate portion therebetween, the bottom edge formed with a pair of opposed and spaced lips extended downwards therefrom and thereby defining a mouth for coupling about a rim of a urinal and with the intermediate portion extended to the top edge, whereby when a rim of a urinal is disposed within the mouth, the strip is coupled to the rim and extends to a position for directing urine drippings towards the urinal.

2 Claims, 3 Drawing Sheets

URINAL DRIP GUARD FOR USE WITH WALL URINALS

BACKGROUND OF THE INVENTION

1. Field of the Invention

The present invention relates to a urinal drip guard for use with wall urinals and more particularly pertains to preventing urine drippings from accumulating on a floor area below a wall urinal with a urinal drip guard for use with wall urinals.

2. Description of the Prior Art

The use of urinal drip prevention apparatuses is known in the prior art. More specifically, urinal drip prevention apparatuses heretofore devised and utilized for the purpose of preventing urine from being deposited upon a floor directly below a urinal are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 259,225 to Scheer discloses a urinal deflector. U.S. Pat. No. Des. 329,893 to Luedtke et al. discloses an anti-splash mat for urinal or the like. U.S. Pat. No. Des. 332,302 to Brown discloses a anti-splash back unit for a urinal screen. U.S. Pat. No. 4,044,405 to Kreiss discloses a target in a bowl or urinal to attract the attention of urinating human males. U.S. Pat. No. 5,027,448 to Wilkins discloses a men's anti-splashback hygienic urinal.

While these devices fulfill their respective, particular objective and requirements, the aforementioned patents do not describe a urinal drip guard for use with wall urinals that is readily installed or removed using no tools and prevents the floor directly below a wall urinal from being damaged from urine drippings.

In this respect, the urinal drip guard for use with wall urinals according to the present invention substantially departs from the conventional concepts and designs of the prior art, and in doing so provides an apparatus primarily developed for the purpose of preventing urine drippings from accumulating on a floor area below a wall urinal.

Therefore, it can be appreciated that there exists a continuing need for new and improved urinal drip guard for use with wall urinals which can be used for preventing urine drippings from accumulating on a floor area below a wall urinal. In this regard, the present invention substantially fulfills this need.

SUMMARY OF THE INVENTION

In the view of the foregoing disadvantages inherent in the known types of urinal drip prevention apparatuses now present in the prior art, the present invention provides an improved urinal drip guard for use with wall urinals. As such, the general purpose of the present invention, which will be described subsequently in greater detail, is to provide a new and improved urinal drip guard for use with wall urinals and method which has all the advantages of the prior art and none of the disadvantages.

To attain this, the present invention essentially comprises, in combination, a strip of flexible elastomeric material having top edge, a bottom edge, and an intermediate portion therebetween. The bottom edge is formed with a pair of opposed, spaced, and arcuate lips extended downwards therefrom and thereby defining a mouth for coupling about a rim of a urinal. The mouth has an interior periphery with an essentially c-shaped cross-section. The intermediate portion is upwardly and arcuately extended from the lips and its thickness gradually decreasing to the top edge. The distance from the top edge to the mouth is about 4 inches. A plurality of spaced and c-shaped spring clips are included. They are generally arranged in sequence and disposed within the strip with each spring clip positioned around and slightly offset from the interior periphery of the mouth. When the rim of a urinal is disposed within the mouth, the springs clips urge the lips against the rim for coupling the strip thereto and the strip extends generally upwards and outwards from the rim to a position for directing urine drippings towards the urinal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved urinal drip guard for use with wall urinals which has all the advantages of the prior art urinal drip prevention apparatuses and none of the disadvantages.

It is another object of the present invention to provide a new and improved urinal drip guard for use with wall urinals which may be easily and efficiently manufactured and marketed.

It is a further object of the present invention to provide a new and improved urinal drip guard for use with wall urinals which is of durable and reliable construction.

An even further object of the present invention is to provide a new and improved urinal drip guard for use with wall urinals which is susceptible of a low cost of manufacture with regard to both materials and labor, and which accordingly is then susceptible of low prices of sale to the consuming public, thereby making such a urinal drip guard for use with wall urinals economically available to the buying public.

Still yet another object of the present invention is to provide a new and improved urinal drip guard for use with wall urinals which provides in the apparatuses and methods of the prior art some of the advantages thereof, while simultaneously overcoming some of the disadvantages normally associated therewith.

Even still another object of the present invention is to provide a new and improved urinal drip guard for use with wall urinals for preventing urine drippings from accumulating on a floor area below a wall urinal.

Lastly, it is an object of the present invention to provide a new and improved urinal drip guard for use with wall urinals comprising a strip of flexible material having top edge, a bottom edge, and an intermediate portion therebetween, the bottom edge formed with a pair of opposed and spaced lips extended downwards therefrom and thereby defining a mouth for coupling about a rim of a urinal and with the intermediate portion extended to the top edge, whereby when a rim of a urinal is disposed within the mouth, the strip is coupled to the rim and extends to a position for directing urine drippings towards the urinal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
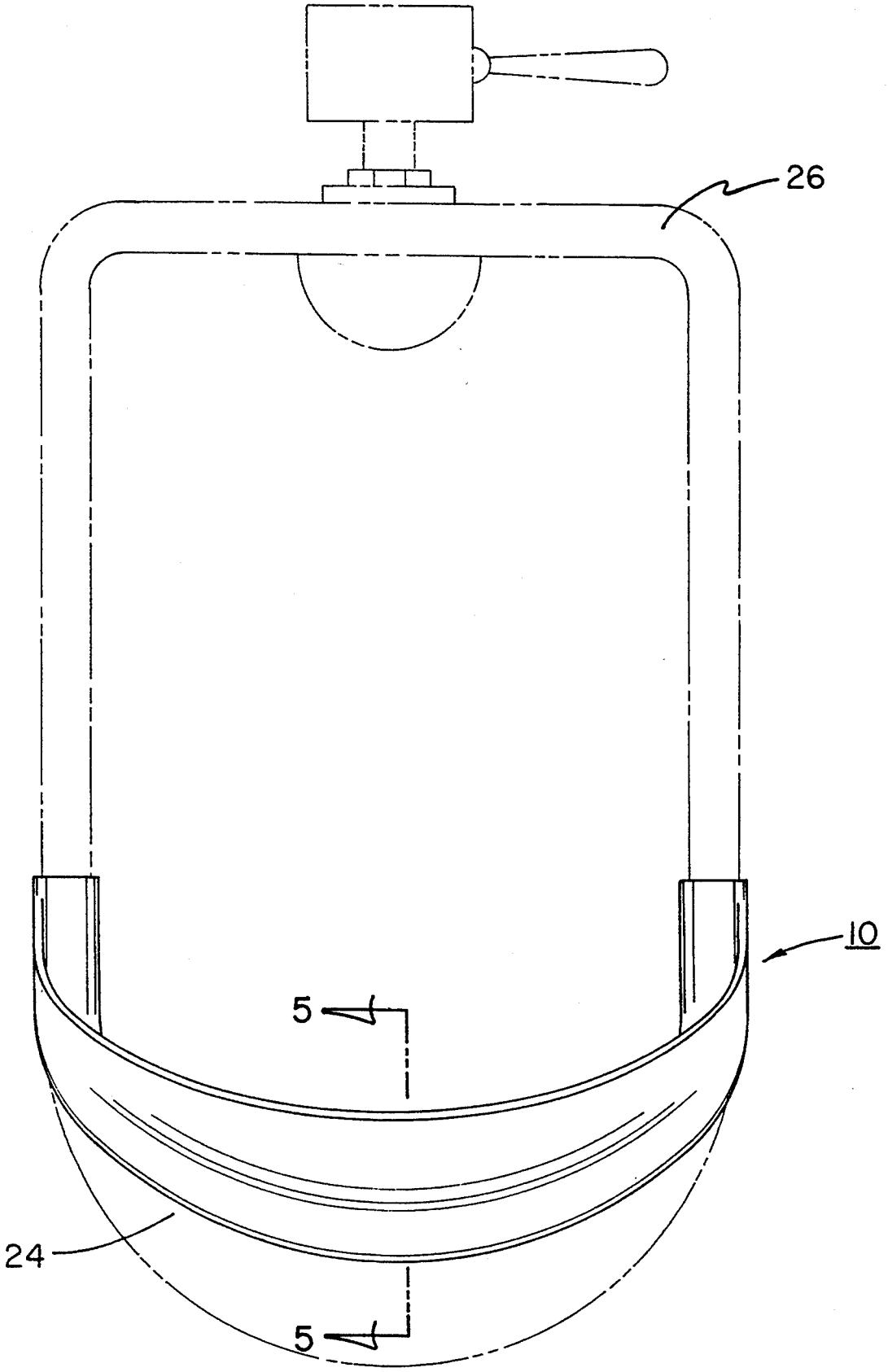
FIG. 1 is a front elevational view of the preferred embodiment constructed in accordance with the principles of the present invention secured to the bottom rim of a urinal.
Figure 2:
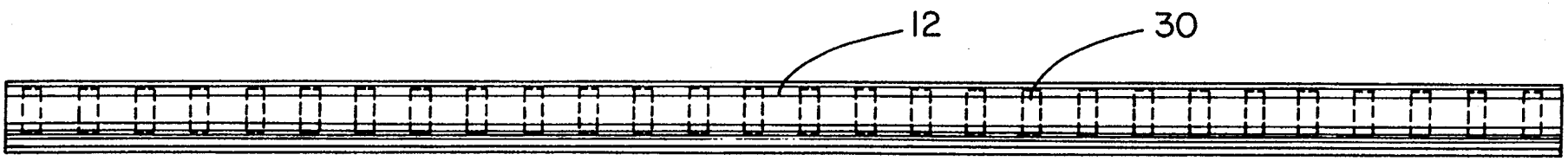
FIG. 2 is a top elevational view of the present invention depicting the arrangement of spring clips within the flexible elastomeric strip when extended in a linear configuration.
Figure 3:
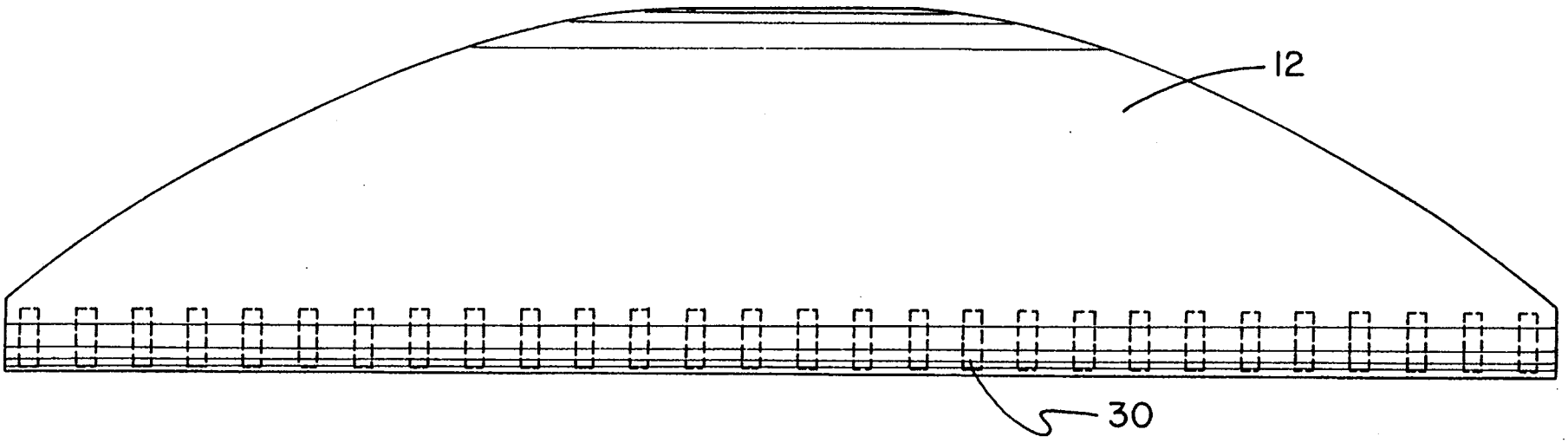
FIG. 3 is a front elevational view of the present invention depicting the arrangement of spring clips within the flexible elastomeric strip and the extension of the strip outwards to its tip end.
Figure 4:
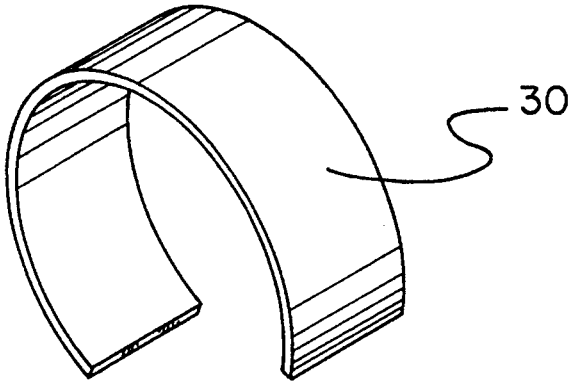
FIG. 4 is a perspective view of a spring clip of the present invention.
Figure 5:
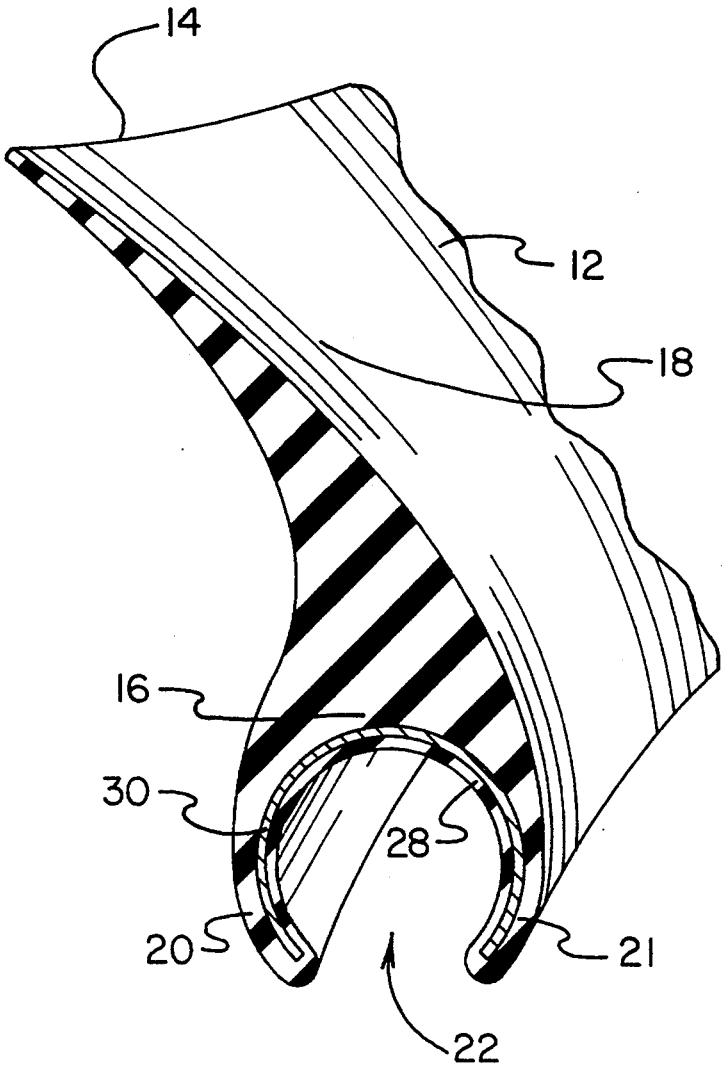
FIG. 5 is a cross-sectional view of the present invention depicting a spring therein.

With reference now to the drawings, and in particular, to FIG. 1 thereof, the preferred embodiment of the new and improved urinal drip guard for use with wall urinals embodying the principles and concepts of the present invention and generally designated by the reference number 10 will be described.

Specifically, the present invention essentially includes two major components. The major components are the strip and the spring clips . These components are interrelated to provide the intended function.

More specifically, it will be noted in the various Figures that the first major component is the strip 12. The strip is formed of an elongated flexible elastomeric material such as plastic or rubber. It has a top edge 14, bottom edge 16, and an intermediate portion 18 therebetween. It also has two free ends. The lengthwise dimension of the strip between the free ends is much greater than its crosswise dimension between the top and bottom edges. The bottom edge is formed of a pair of opposed, spaced, and arcuate lips 20 extended downwards therefrom and thereby defining a mouth 22. Each lip has an upper part integral coupled with the intermediate portion and a lower part extended downwards therefrom. The lips are further extended along the length of the bottom edge. The mouth is used for coupling about a rim 24 of a urinal 26. The mouth has an interior periphery 28 with an essentially c-shaped cross section. The intermediate portion of the strip is upwardly and arcuately extended from the upper parts of the lips with its thickness gradually decreasing to the top edge. In the preferred embodiment, the transverse distance from the top edge to the mouth is about four inches. However, this transverse distance may increased or decreased when the strip is initially manufactured based on urinal type.

The second major component is the spring clips 30. The present invention includes a plurality of spaced and c-shaped spring clips. Each spring clip is formed of metal, plastic, or similar rigid material possessing spring-like properties. The spring clips are generally arranged in sequence within the strip. Each spring clip is positioned around and slightly offset from the interior periphery 28 of the mouth. When the rim of a urinal is disposed within the mouth, the spring clips urge the lips against the rim, thereby coupling the strips thereto. The strip extends generally upwards and outwards from the rim to a position for directing urine drippings towards a urinal.

The present invention is designed for use on "stand-up" wall urinals to prevent the accumulation of drippings on the surrounding floor area. It is simply formed of a contoured flexible plastic strip which is shaped to match the lower curvature of the urinal itself over its longitudinal dimension and is about four inches long across its width. The present invention is affixed directly to the rim of a urinal to effectively form a curved shelf for directing urine drippings towards the urinal thereby protecting tiles and other flooring material below the urinal from being stained or corroded by urine drippings.

The typical urinal simply does not extend far enough from its supporting wall to entrap all of the drippings, and the result of this shortcoming is both expensive and unsanitary. The grouting used with most restroom or bathroom tiles is readily damaged by a strong medium such as urine, and frequent maintenance of these tiles is therefore required. This maintenance is, of course, far more expensive than the simple one-time installation of the present invention.

Secondly, even if the flooring material is not yet ruined by urine drippings, the restroom will be unsanitary and probably permeated with unpleasant odors. This in itself can be very costly to the proprietor of any public business. For example, customers of an otherwise acceptable restaurant would be discouraged to return simply because it is unpleasant to use the restroom, and business will suffer. The present invention addresses and eliminates these problems. It should indeed be a valuable acquisition for anyone charged with the responsibility of maintaining public restrooms.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed and desired to be protected by Letters Patent of the United States is as follows:

1. A urinal drip guard for use with wall urinals for preventing urine drippings from accumulating on a floor area below a wall urinal comprising, in combination:

a strip of flexible elastomeric material having a top edge, a bottom edge, and an intermediate portion therebetween, the bottom edge formed with a pair of opposed, spaced, elongated and arcuate lips extended downwards therefrom and thereby defining a mouth for coupling about a rim of a urinal and with the mouth having an interior periphery with an essentially c-shaped cross-section, the intermediate portion upwardly and arcuately extended from the lips and with its thickness gradually decreasing to the top edge, the distance from the top edge to the mouth being about 4 inches; and a plurality of spaced and c-shaped spring clips generally arranged in sequence and disposed within the strip with each spring clip positioned around and slightly offset from the interior periphery of the mouth;

whereby when the rim of a urinal disposed within the mouth, the springs clips urge the lips against the rim for coupling the strip thereto and the strip extends generally upwards and outwards from the rim to a position for directing urine drippings towards the urinal.

2. A urinal drip guard for use with wall urinals comprising a strip of flexible material having top edge, a bottom edge, and an intermediate portion therebetween, the bottom edge formed with a pair of opposed and spaced lips extended downwards therefrom and thereby defining a mouth for coupling about a rim of a urinal and with the intermediate portion extended to the top edge, and a plurality of spring clips generally arranged and disposed within the strip with each spring clip positioned about the interior periphery of the mouth, whereby when a rim of a urinal is disposed within the mouth, the spring clips urge the lips against the rim for coupling the strip thereto and the strip extends upwards to a position for directing urine drippings towards the urinal.

* * * * *